United States Patent [19]

Ogata et al.

[11] 4,408,863

[45] Oct. 11, 1983

[54] TRANSFER MEDIUM SEPARATING DEVICE

[75] Inventors: Yoshihiro Ogata, Yokohama; Koji Sakamoto, Tokyo; Harumi Takahashi; Koji Hirakura, both of Yokohama, all of Japan

[73] Assignee: Ricoh Company, Ltd., Japan

[21] Appl. No.: 284,454

[22] Filed: Jul. 17, 1981

[30] Foreign Application Priority Data

| | | | |
|---|---|---|---|
| Jul. 21, 1980 | [JP] | Japan | 55-98697 |
| Jul. 21, 1980 | [JP] | Japan | 55-98698 |
| Jul. 21, 1980 | [JP] | Japan | 55-98699 |
| Dec. 10, 1980 | [JP] | Japan | 55-177106[U] |

[51] Int. Cl.[3] ..... G03G 15/14; G03G 15/22

[52] U.S. Cl. ..... 355/3 TR; 271/307; 271/310; 271/313; 355/14 SH; 355/14 TR

[58] Field of Search ..... 355/3 R, 3 TR, 3 SH, 355/14 TR, 14 SH; 271/307, 308, 309, 310, 312, 313, DIG. 2

[56] References Cited

U.S. PATENT DOCUMENTS

| | | | |
|---|---|---|---|
| 3,832,053 | 8/1974 | Goel et al. | 355/3 TR |
| 3,981,498 | 9/1976 | Fletcher | 355/3 R X |
| 4,027,960 | 6/1977 | Ladrigan | 355/3 R |
| 4,168,830 | 9/1979 | Hori et al. | 271/195 X |
| 4,183,653 | 1/1980 | Satomi et al. | 355/3 SH |
| 4,190,348 | 2/1980 | Friday | 355/3 TR |
| 4,286,862 | 9/1981 | Akita et al. | 355/3 SH |

FOREIGN PATENT DOCUMENTS

| | | | |
|---|---|---|---|
| 2065558 | 7/1981 | United Kingdom | 271/310 |

*Primary Examiner*—Fred L. Braun

*Attorney, Agent, or Firm*—Guv W. Shoup; Gerard F. Dunne; Eliot S. Gerber

[57] ABSTRACT

In a copy paper separating device for use in a transfer type electrophotographic copying machine which includes a conductive carrier member, preferably in the form a conductive endless belt extended between a pair of pulleys. The conductive carrier member is disposed in the periphery of the photosensitive member to which a copy paper is brought into contact for the transfer of a toner image formed on the photosensitive member. The potential of the conductive carrier member is maintained nearly at zero level during the first step of the separating operation; whereas, the potential of the carrier member is increased to a predetermined value of the polarity opposite to that of the toner image during the second step.

18 Claims, 12 Drawing Figures

TRANSFER MEDIUM SEPARATING DEVICE

BACKGROUND OF THE INVENTION

1. Field of the Invention

This invention relates to a transfer medium separating device for separating a transfer medium bearing thereon a toner image from a carrier member with which the transfer medium is in contact. More in particular, the present invention is concerned with a copy paper separating device in an electrophotographic copying machine for separating a copy paper from the surface of a photosensitive member.

2. Description of the Prior Art

In a transfer type electrophotographic copying machine, a photosensitive member, usually provided on the peripheral surface of the drum which is driven to rotate at constant speed, is first uniformly charged to a predetermined polarity by a corona charger. Then, a light image is exposed onto the thus charged surface of the photosensitive member thereby selectively removing the charges to form an electrostatic latent image by the remaining charges. Torner particles charged in the polarity opposite to that of the electrostatic latent image are applied to form a visible toner image. Next, a transfer medium such as a copy paper is brought into contact with the surface of the photosensitive member bearing thereon the toner image.

At this transferring station, a corona charger is usually used to apply charges of the polarity opposite to that of the toner image onto the backside of the copy paper so that the toner image may be electrostatically attracted to the front side of the copy paper. Thereafter, the copy paper, which is now in contact with the surface of the photosensitive member at least partly, is separated from the surface of the photosensitive member and then transported to a fixing station where the transferred toner image is permanently fixed to the copy paper by fusing. On the other hand, the photosensitive member is then subjected to a cleaning operation to remove any residual toner particles, and thereafter the photosensitive member is prepared for the next cycle of copying operation.

This type of electrophotographic copying machine has become very popular and is widely used partly because of its ability to use a plain copy paper. Among the many factors considered in judging the performance of this type of copying machine, the transferring efficiency, i.e., the ability to transfer the toner image from the photosensitive member to the copy paper, is often one of the most important factors. In order to obtain high transferring efficiencies, it is a common practice to bring the copy paper in intimate contact with the photosensitive member. This then leads to a problem of separating the copy paper from the photosensitive member since they are strongly attracted to each other.

One conventional and common approach was to use a separating pawl in combination with a charge neutralizer which is comprised essentially of a corona charger. That is, in accordance with this prior art technique, after the application of the transferring charges, the copy paper is electrostatically neutralized and the leading edge of the copy paper is brought into engagement with the pawl as the photosensitive drum rotates and the copy paper is thereby mechanically separated from the photosensitive member gradually from its leading edge. However, there are numerous disadvantages in this prior art technique.

One of the disadvantages of the separating pawl approach is the difficulty for appropriate neutralization of the copy paper. For example, if the neutralization is insufficient, the copy paper may strongly adhere to the photosensitive member, which, in turn, could cause problems such as tearing of the copy paper during the separating operation. On the other hand, if an excessive neutralization is carried out, the electric field for attracting the toner particles to the copy paper becomes weaker, which, in turn, could bring about lowering of the transferring efficiency as well as the image density. Another disadvantage stems from the fact that the pawl is provided to be always in contact with the surface of the photosensitive member. This structure easily allows scratches to be formed on the photosensitive surface, for example, when a foreign matter such as debris gets sandwiched between the pawl and the surface. This is especially true for a photosensitive member comprised of organic materials.

Another proposed approach was to place a conductive member in the neighborhood of the copy paper which has been subjected to the transfer operation. In this case, an electrostatic attractive force is induced between the copy paper and the conductive member so that the copy paper may be removed from the photosensitive member. However, no practically applicable structure has yet been proposed.

SUMMARY OF THE INVENTION

The disadvantages of the prior art are overcome with the present invention and an improved device for separating a transfer medium from a carrier member such as a photosensitive member without lowering the transfer efficiency is provided.

The advantages of the present invention are attained by providing a conductive carrier member, a part of which is located in the proximity of the surface of the photosensitive member, and by applying a variable voltage of the conductive carrier member under control. Preferably, the conductive carrier member is in the form of an endless belt extended between a pair of pulleys. The potential of the conductive belt is controlled such that it is kept nearly at zero voltage in the first part of the separating operation so that the leading part of the copy paper is attracted toward the belt because of the attractive force therebetween. Then, in the second part of the separating operation, the potential of the belt is increased to a predetermined value of the polarity opposite to that of the toner image in order to securely retain the toner particles on the surface of the transfer medium.

The present invention is characterized by changing the potential of the conductive carrier member in two steps in order to insure an excellent separation with high toner transfer efficiencies. The timing to change potentials is important in the present invention. In one form of the present invention, the potential of the conductive carrier member is changed after elapsing a predetermined period of time from the time when the leading edge of the transfer medium has passed a reference point. Alternatively, the present invention proposes to provide a sensor to detect the position of a transfer medium and the potential of the conductive carrier member is changed in response to a signal from the sensor. Still alternatively, the present invention proposes to change the potential of the conductive carrier member by detecting the induced voltage of the conductive carrier member, which occurs when the charged transfer medium approaches. Moreover, the transfer charger may be advantageously employed to change the potential of the conductive carrier member.

Therefore, it is an object of the present invention to provide an improved transfer medium separating device.

Another object of the present invention is to provide a transfer medium separating device which insures a stable separation with high toner transfer efficiencies.

A further object of the present invention is to provide a transfer medium separating device for use in a transfer type electrophotographic copying machine, whereby the surface of the photosensitive member is prevented from receiving scars from the separating device.

A still further object of the present invention is to provide a transfer medium separating device which can carry out an excellent separation irrespective of the kind of a transfer medium and the ambient conditions such as temperature and moisture.

Other objects, advantages and novel features of the present invention will become apparent from the following detailed description of the invention when considered in conjunction with the accompanying drawings.

DESCRIPTION OF THE PREFERRED EMBODIMENTS

Figure 1:
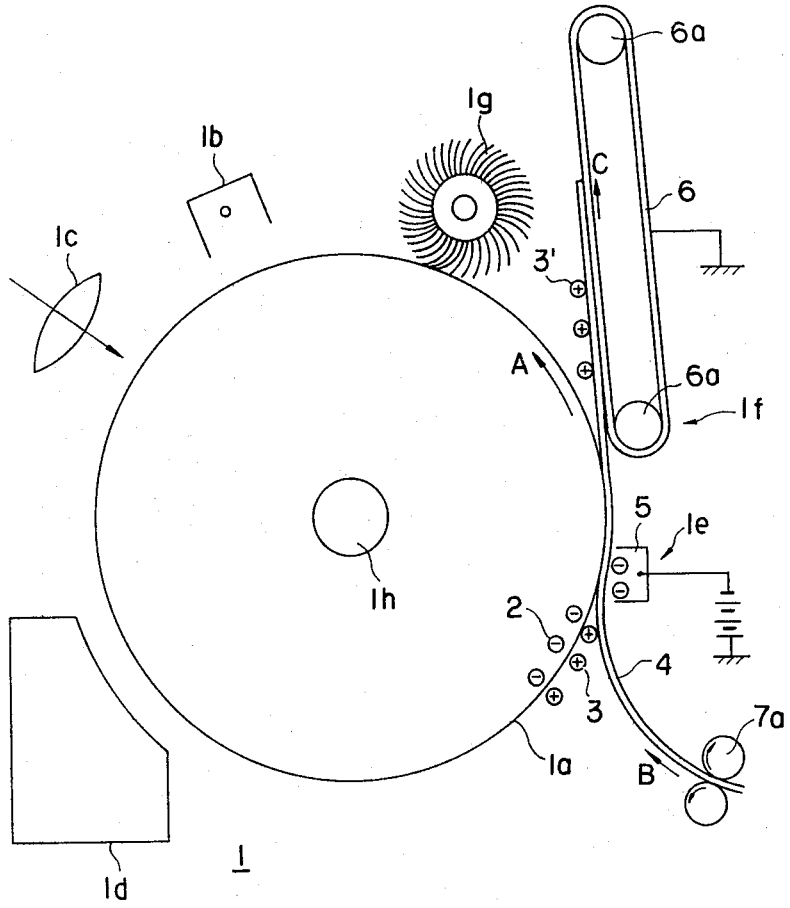
FIG. 1 is a schematic illustration of a typical transfer type electrophotographic copying machine useful for explaining the principle of the present invention.

Referring now to FIG. 1 which schematically shows the structure of a transfer type electrophotographic copying machine 1, a photosensitive drum 1*a* is rotatably journaled to a machine housing (now shown) and driven to rotate in the direction indicated by the arrow A at constant speed. As the drum 1*a* rotates, the surface of the drum 1*a*, which is sometimes referred to as a photosensitive surface, is uniformly charged by a corona charger 1*b* and then receives a light image through an image exposure system 1*c* thereby selectively dissipating the charges applied by the charger 1*b* to form an electrostatic latent image 2 on the drum surface. Then, the electrostatic latent image 2 is developed at a developing device 1*d* to form a visible toner image 3. In this example, since the electrostatic latent image 2 is formed by negative charges, the toner particles which form the toner image 3 possess positive charges.

When the toner image 3 is brought into a transfer station 1*e*, it is brought into contact with the front surface of a copy paper 4 which travels in the direction indicated by the arrow B in synchronism with the rotation of the drum 1*a*. In the transfer station 1*e* is provided a transfer corona charger 5 which applies negative charges to the rear surface of the copy paper 4 thereby attracting and transferring the toner image 3 onto the front surface of the copy paper 4. The copy paper 4 is usually brought into close contact with the photosensitive surface of the drum 1*a* to obtain a high transferring efficiency, for example, by means of rollers.

Downstream of the transfer station 1*e* is provided a separating station 1*f* which includes a conductive endless belt 6 extended between a pair of pulleys 6*a* to travel in the direction indicated by the arrow C. A part of the belt 6, is placed in the proximity of the photosensitive surface of the drum 1*a*. Accordingly, when the copy paper 4 having the transferring negative charges on the rear surface thereof as applied by the charger 5 comes into the separating station if, the mirror charges of the positive polarity will be induced in that portion of the belt 6 which is opposed to the copy paper 4. As a result, the copy paper 4 having the transferred toner image 3' on its front surface is separated from the surface of the drum 1*a* and attracted to the belt 6 because of an electrostatic attractive force induced between the copy paper 4 and the belt 6. On the other hand, the photosensitive drum 1*a*, after separation of the copy paper 4, is brought to a cleaning staton 1*g* where residual toner particles are removed, thereby preparing the drum 1*a* for the next cycle of copying operation.

Returning to the separating station 1*f*, the potential of the belt 6 plays an important role in the separating operation. If the belt is grounded as shown in FIG. 1, the transferring negative charges applied to the rear surface of the copy paper 4 will escape at least partly to ground as soon as the copy paper 4 has been attracted to the belt 6. In this arrangement, although an excellent separating performance can be attained, some of the charges of the transferred toner image 3' are transferred back to the photosensitive drum 1*a* because of the escape of the transferring charges, thereby lowering the net transferring efficiency. On the other hand, if the potential of the belt is allowed to float, the belt will gradually increase its negative potential by acquiring the transferring charges from the rear surface of the copy paper 4. This arrangement helps keep the charges of the transferred toner image 3' on the front surface of the copy paper 4, but there is a problem in separating performance since there is a tendency to increase the electrostatic repulsion between the copy paper 4 and the belt 6. Therefore, there exist seemingly incompatible requirements at the separating station.

Figure 2:
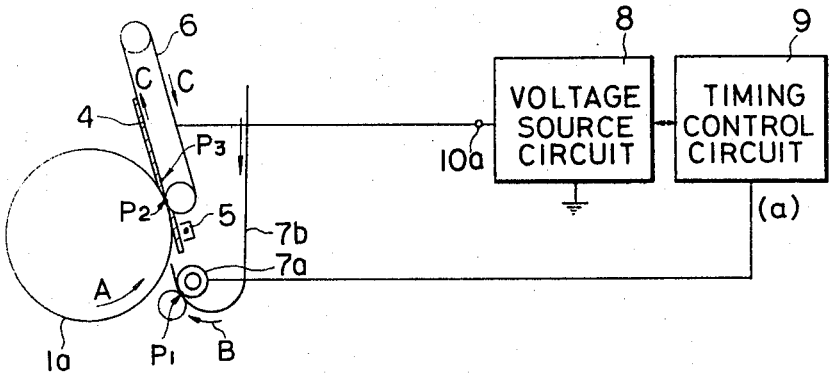
FIG. 2 is a schematic illustration partly shown in block diagram of one embodiment of the present invention.

Now, description will be made with respect to FIGS. 2 and 3 which show one embodiment of the present invention. In FIG. 2, there are shown only those elements which are necessary for the explanation of the first embodiment of the present invention, and, as practiced throughout this specification and the drawings, like numerals indicate like elements.

As shown, upstream of the transfer corona charger 5 is provided a register roller *7a* in a copy paper travelling path *7b*. The register roller *7a* is normally held stationary to block the advancement of the copy paper 4 toward the transfer station. When a register signal (waveform (a) in FIG. 4) is applied, the roller *7a* starts to rotate to advance the copy paper 4 in the direction indicated by the arrow B in association with the rotation of the drum *1a*. It is to be noted that a voltage source circuit 8 is connected to the belt 6 and a timing control circuit 9 is provided as connected between the circuit 8 and the register roller *7a*. With such a structure, the potential of the belt 6 may be controlled in association with the operation of the register roller *7a* as will be fully described hereinbelow.

Figure 3:
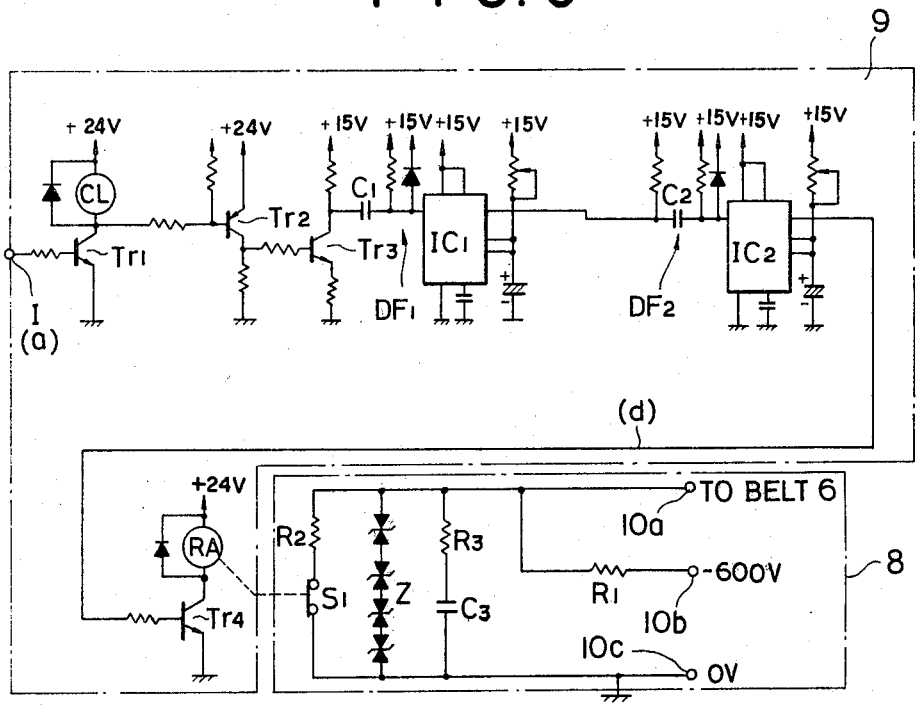
FIG. 3 is a circuit diagram showing details of the blocks shown in FIG. 2.
Figure 4:
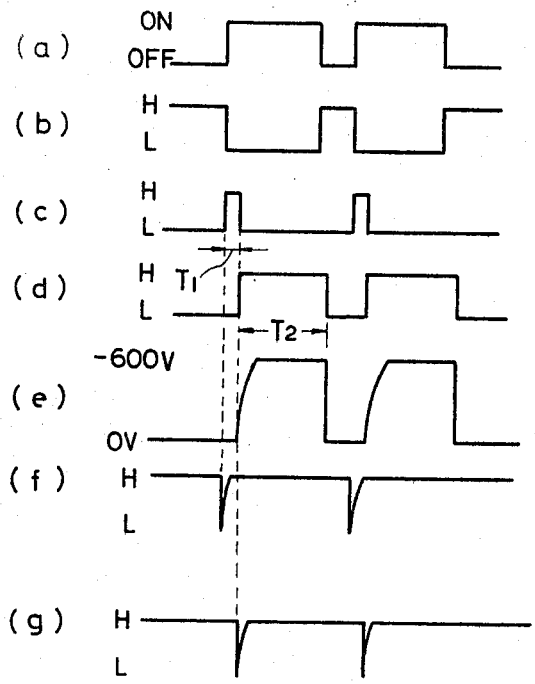
FIG. 4 is a timing chart showing several waveforms at appropriate points in the circuit of FIG. 3.

FIG. 3 shows one example of the detailed structure of the circuits 8 and 9 shown in FIG. 2. When the register signal (a) shown in FIG. 4 is supplied to an input terminal I of the timing control circuit 9, the transistor Tr1 is turned on thereby coupling the electromagnetic clutch CL to start the rotation of the register roller *7a*. At the same time, transistors Tr2 and Tr3 are turned on so that the collector of the transistor Tr3 changes its state from a high level to a low level as shown by the waveform (b) in FIG. 4. This change in state is applied to a first differentiating circuit DF1 including the capacitor C1, so that the trigger pulse signal (f) shown in FIG. 4 is supplied to the first timer IC1. When triggered, the first timer IC1 maintains its output at high level for a time period of T1 as shown by the waveform (c) of FIG. 4.

The output from the timer IC1 is supplied to a second differentiating circuit DF2 including the capacitor C2. At the falling end of the signal (c), the second differentiating circuit DF2 supplies as its output the trigger signal (g) which is supplied as an input to the second timer IC2. As shown by the waveform (d) of FIG. 4, the second timer IC2 supplies a high level output to the transistor Tr4 for a time period of T2 when triggered by the signal (g). While the transistor is on, the relay RA is kept energized. The relay RA is operatively associated with the normally closed switch S1 of the voltage source circuit 8.

The voltage source circuit 8 has three terminals: output terminal 10*a* connected to the conductive belt 6, high voltage terminal 10*b* connected to a constant voltage source (not shown) of, for example, −600 V and ground terminal 10*c* connected to the ground. The terminals 10*a* and 10*c* are connected each other through the resistor R2 and the switch S1; moreover, the terminal 10*a* is connected to the high voltage terminal 10*b* via the resistor R1. Furthermore, between the terminals 10*a* and 10*c* are connected the constant voltage device Z and a series circuit comprised of the resistor R3 and the capacitor C3.

In operation, as long as the relay RA is not energized, the switch S1 is kept closed so that the potential of the terminal 10*a* and thus the belt 6 is nearly at zero level. On the other hand, if the relay RA is energized to turn the switch S1 off, the capacitor C3 is gradually charged by the high voltage terminal 10*b* through the resistors R1 and R3 at a rate governed by the time constant determined by the resistors R1, R2 and the capacitor C3. Therefore, the potential of the output terminal 10*a* and thus the belt 6 increases up to −600 V as shown in FIG. 4, waveform (e).

Figure 5:
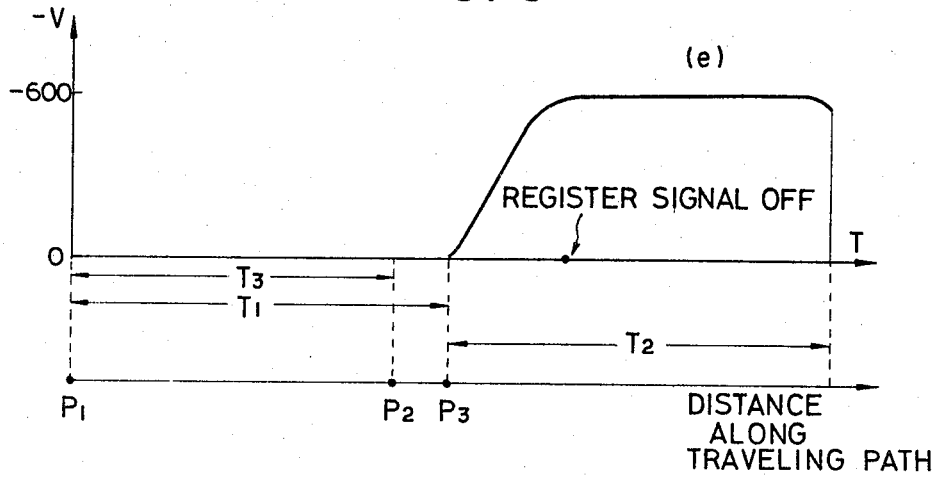
FIG. 5 is a graph showing the variation of potential of the belt in the embodiment shown in FIG. 2.

FIG. 5 shows the variation in time of the potential of the belt 6 in accordance with the embodiment described above. It also shows the variation of the potential of the belt 6 in relation to the position of the copy paper 4 along its traveling path.

As shown, at time T=0, the register signal (a) is supplied to start the rotation of the register roller *7a*, and at the same time, the copy paper 4 starts its advancement with its leading edge at a point P1 defined at the contact point of the register roller *7a*. At time T=T3, the leading edge of the copy paper 4 reaches a point P2 defined by the contact or closest point between the drum *1a* and the belt 6; at this time, the belt 6 is still nearly at zero level since the switch S1 remains closed. As the copy paper 4 advances further and when its leading edge reaches a point P3 which corresponds to a predetermined time T1 set by the time IC1, the relay RA becomes energized to turn the switch S1 off. Accordingly, the potential of the belt 6 starts to increase gradually in the negative polarity and finally reaches −600 volts. The timer IC2 starts its operation at T=T1 and continues its operation for a time period of T2. The time T2 is determined to be long enough to complete the separating operation. After elapsing the time T2, the belt 6 is returned to its original state as a preparation for the next cycle of operation.

As described above, when the leading edge of the copy paper 4 arrives at the point P2, the belt 6 is still maintaining nearly at zero level so that the leading portion of the copy paper 4 is strongly attracted toward the belt 6 away from the drum *1a*. This continues until the leading edge of the copy paper 4 has reached the point P3. Thus, for a time period during which the leading edge travels from the point P2 to the point P3, some of the transferring charges on the rear surface of the copy paper 4 escape to the ground thereby allowing some of the toner particles on the front surface to be retransferred to the drum *1a*, resulting in lowered transfer efficiencies at the leading portion of the copy paper 4. It should, however, be noted that this does not present any problems practically because the leading portion of the copy paper 4 where the retransfer occurs will likely be located in the margin of the copy paper 4.

The belt 6 starts to increase its potential gradually in the negative polarity when the time period T1 has elapsed so that the electrostatic attraction decreases with recovering an excellent transfer performance. Even if the attraction force is weakened due to the increased negative potential of the belt 6, since the copy paper 4 moves away from the drum *1a* once brought into contact with the belt 6 and therefore it stays in contact with the belt 6. Thus, a decrease in attraction force at this time would not cause any problem in the separating function. On the contrary, setting the belt 6 in the negative polarity helps keep the positive toner particle on the front surface of the copy paper 4, leading to a high transfer efficiency. The copy paper now advances in the direction indicated by the arrow C.

The capacitor C3 and the resistors R1 and R3 provided in the circuit 8 can assure the gradual increase of the potential of the belt 6 thereby a sharp change can be prevented from appearing in the leading portion of the copy paper 4. It should further be noted that although the relationship between the time periods T1 and T3 has been selected as T1>T3 in the above example, the other possibilities, i.e., T1=T3 and T1<T3, are equally applicable to the present invention. Selection should be made in consideration of the rising characteristics of the potential of the belt 6.

Figure 6:
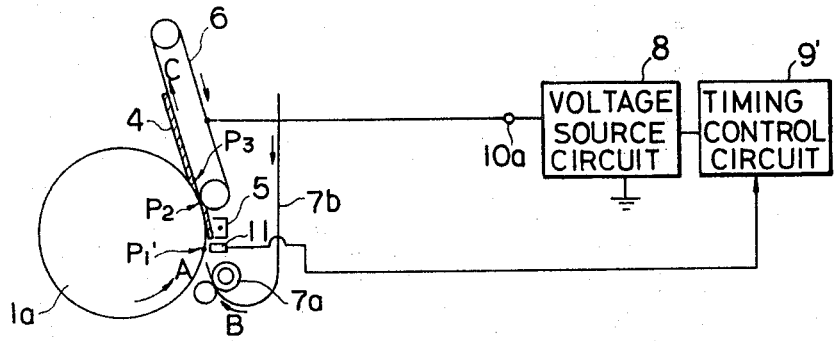
FIG. 6 is a schematic illustration partly in block diagram showing another embodiment of the present invention.
Figure 7:
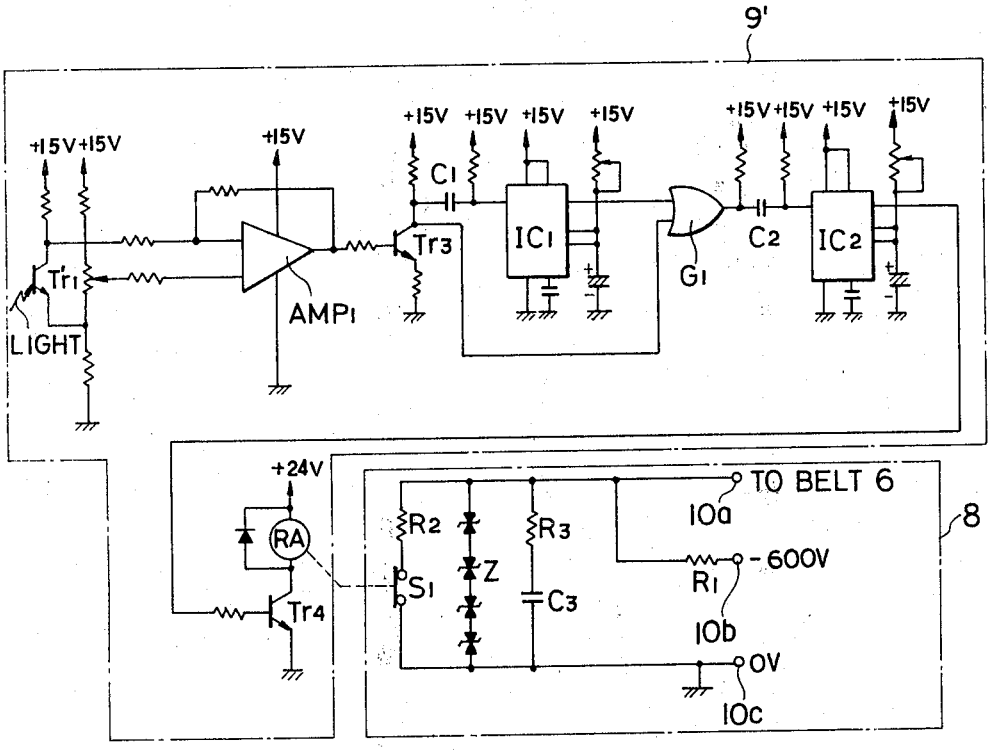
FIG. 7 is a circuit diagram showing details of the blocks shown in FIG. 6.

FIGS. 6 and 7 show a second embodiment of the present invention. As shown in FIG. 6, this second embodiment is very similar to the first embodiment shown in FIG. 2 excepting that a sensor 11 is provided in the copy paper traveling path 7*b* between the register roller 7*a* and the transfer corona charger 5 in the second embodiment. The sensor 11 is connected to the timing control circuit 9 and therefore the sensor 11 senses the leading edge of the copy paper 4 and supplies a sense signal to the circuit 9 for the actuation thereof. The sensor 11 may be any conventional mechanical or photoelectrical sensing device such as a feeler, photodiode or phototransistor.

FIG. 7 shows the exemplary detailed structure of the circuits 8 and 9'. The circuit 8 of FIG. 7 is the same as the circuit 8 of FIG. 3, and the circuit 9' of FIG. 7 is virtually the same as the circuit 9 of FIG. 3 excepting that the transistor Tr1' is a phototransistor forming a part of the sensor 11 and a differential amplifier AMP1 is provided instead of the transistor Tr2 with the addition of an OR gate G1. Since the operation of this second embodiment is virtually the same as that of the first embodiment, it will not be repeated here. The only difference exists in the definition of the initial time. That is, in the second embodiment, the initial time is defined by the time when the leading edge of the copy paper 4 has reached the sensor 11. This should be taken into account when the graph of FIG. 5 is used to understand the operation of this second embodiment. Otherwise, there is no significant difference between the first and second embodiments.

Figure 8:
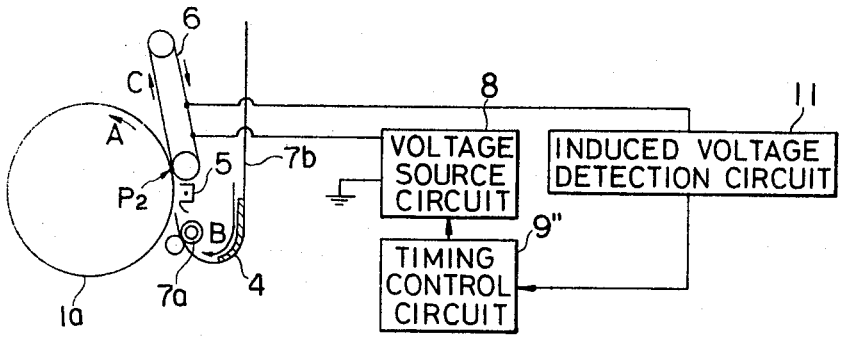
FIG. 8 is a schematic illustration partly in block diagram showing a further embodiment of the present invention.
Figure 9:
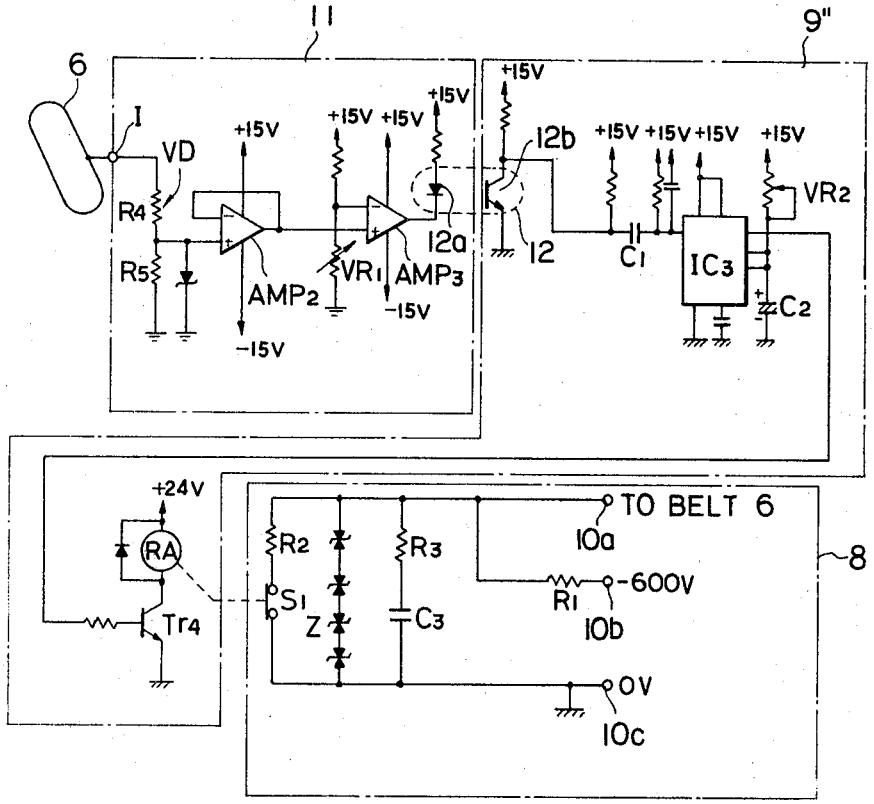
FIG. 9 is a circuit diagram showing details of the blocks shown in FIG. 8.

FIGS. 8 and 9 show a third embodiment of the present invention, which is characterized by controlling the potential of the belt 6 by detecting the induced voltage thereof. This third embodiment also includes the voltage source circuit 8 and the timing control circuit 9'', but no signal is fed from the register roller 7*a* and no provision is made of the sensor 11. Instead, this embodiment further includes an induced voltage detection circuit 11 connected between the belt 6 and the circuit 9''. The detection circuit 11 detects the changes in the potential of the belt 6 as the charged copy paper 4 approaches. When the induced voltage reaches a predetermined value, an output signal is supplied to the timing control circuit 9'' to trigger it. Then, in accordance with a signal from the timing control circuit 9'', the voltage source circuit 8 is activated to apply a voltage having a predetermined value and polarity to the belt 6.

FIG. 9 shows one example of the detailed structure of the circuits 8, 9'' and 11 in FIG. 8. As shown, the induced voltage detection circuit 11 includes the input terminal I which is connected to the belt 6. The input terminal I is also connected to a voltage driver VD comprised of the resistors R4 and R5. The output of the voltage divider VD is connected to one input of the amplifier AMP2 having a high input impedance. The output of the amplifier AMP2 is connected to one input of the amplifier AMP3, the output of which is connected to the light emitting diode 12*a* constituting a part of the photocoupler 12. A variable resistor VR1 is connected to the other input of the amplifier AMP3 so that its threshold voltage may be appropriately adjusted.

The timing control circuit 9'' comprises the phototransistor 12*b* which constitutes the remaining part of the photocoupler 12. The collector of the phototransistor 12*b* is connected to a differential circuit including the capacitor C1, the output of which is connected to the input of the timer IC3 to which are connected the capacitor C2 and the variable resistor VR2. The output of the timer IC3 is connected to the base of the transistor Tr4 and the timer IC3 maintains the transistor Tr4 on for a time period determined by the values of the variable resistor VR2 and the capacitor C2. To the collector of the transistor Tr4 is connected the electromagnetic relay RA which is operatively associated with the normally closed switch S1 of the voltage source circuit 8. The structure of the circuit 8 is the same as that of each of the above two embodiments and therefore explanation will not be repeated here. It is to be noted, however, that in each of the three embodiments so far described, the values of the resistors R1, R2 and R3 should be selected to satisfy the condition that $R1 > R2, R3$.

In operation, when the register roller 7*a* is started to rotate in association with the rotation of the drum 1*a*, the copy paper 4 initiates its advancing motion toward the transfer station where the copy paper receives transferring charges on its back surface from the corona charger 5. At the time when the leading edge of the copy paper 4 reaches the point P2 defined by the contact or closest point between the drum 1*a* and the belt 6, the potential of the belt 6 is nearly at zero level since the belt is connected to the ground through the resistor R2 and the switch S1. As a result, there appears a strong electrostatic attractive force between the leading portion of the copy paper 4 and the belt 6 so that the leading portion of the copy paper 4 moves away from the drum 1*a* and comes into contact with the belt 6. In this instance, since the transferring charges on the rear surface of the leading portion of the copy paper 4 escape to the ground at least partly, the force for holding the toner particles on the front surface of the copy paper 4 becomes weakened thereby allowing the toner particles to be retransferred back to the drum 1*a* at least partly. During this first step of the separating operation, the transfer performance is sacrificed to some extent to insure a high separation performance.

As the charged copy paper 4, which has negative charges on its rear surface, approaches the belt 6, charges are electrostatically induced in the belt 6. The positive charges are distrubuted so that portion of the belt which is located as opposed to the negatively charged copy paper 4. These opposite charges bring the copy paper 4 in contact with the belt 6 so that they cancel out and the belt 6 is left with some negative charges. The potential of the belt 6 thus increased negatively is detected by the detection circuit 11. If the detected value has reached a predetermined value V0, the timing control circuit 9'' is activated. In other words, the photocoupler 12 transmits the output of the detection circuit 11 to the control circuit 9'' to trigger the timer IC3. When triggered, the timer IC3 maintains the transistor Tr4 on for a time period of T4. During this time period, the relay RA is kept energized to turn the switch S1 off. As a result, the belt 6 is set to a predetermined voltage, −600 volts in this example, as described before.

Figure 10:
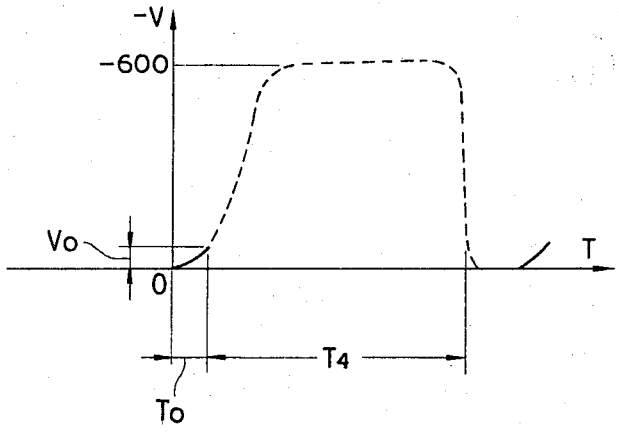
FIG. 10 is a graph showing the variation of potential of the belt in the embodiment shown in FIG. 8.

FIG. 10 is the graph showing the history of potential variation of the belt 6 in accordance with the third embodiment of the present invention. In this case, time $T=0$ is defined by the time when the leading edge of the copy paper 4 has reached the point P2. At $T=0$, the leading edge of the copy paper 4 starts to move toward the belt 6 to initiate the separating operation. For a time period of T0, the potential of the belt 6 rises to the value V0 as indicated by the solid line. Upon reaching V0, the voltage is applied to the belt 6 from the circuit 8 so that the potential of the belt 6 gradually increases to a predetermined value, or −600 volts in this example, as indicated by the dashed line. Upon elapsing time T4, during which the separation operation has been completed, the timer IC3 supplies a termination signal and the original condition is restored as a preparation for the next cycle of operation.

Figure 12:
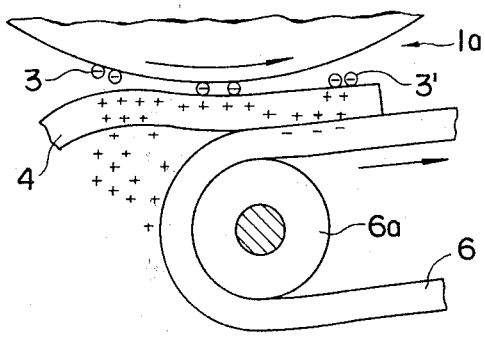
FIG. 12 is a schematic illustration showing the separating point and its surrounding of the embodiment of FIG. 11 on an enlarged scale.
Figure 11:
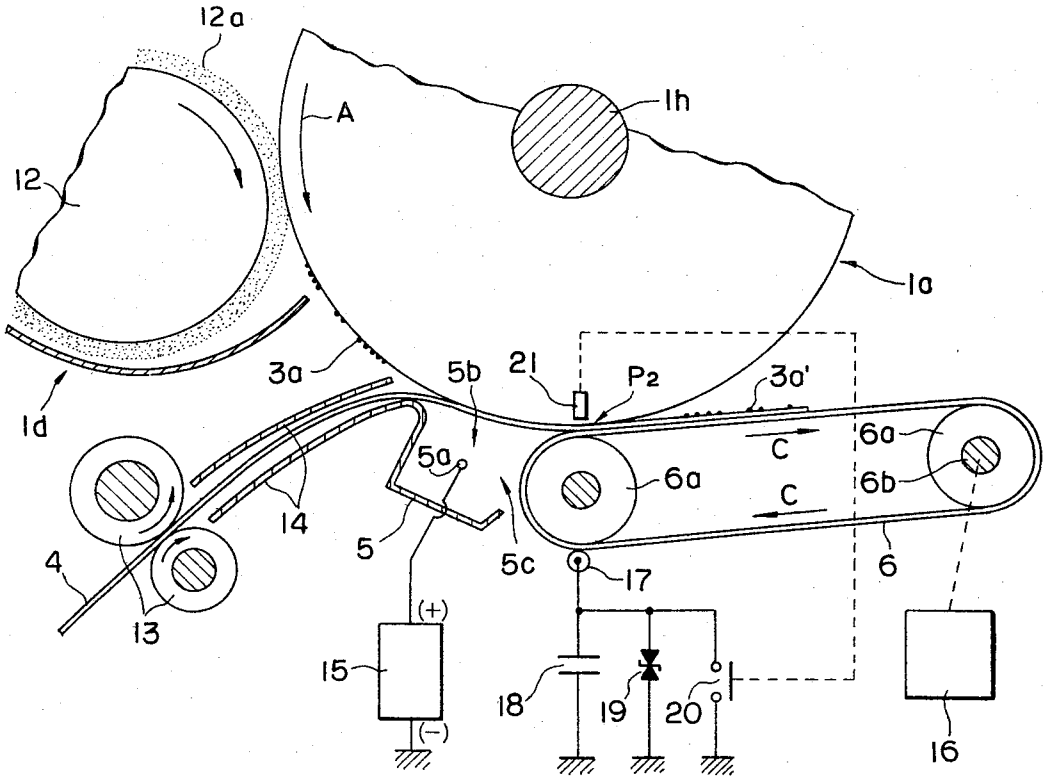
FIG. 11 is a schematic illustration showing a still further embodiment of the present invention.

FIGS. 11 and 12 show a fourth embodiment of the present invention which is characterized by controlling the potential of the belt 6 by directing a part of the corona ions produced by the transfer corona charger toward the belt 6.

In FIG. 11, a developing roller 12 with a toner layer 12*a* formed on the peripheral surface thereof is shown at the developing station 1*d*. In this embodiment, it is assumed that an electrostatic latent image is formed by positive charges as different from the previous three embodiments. Thus, the toner particles are negatively charged and they are applied to the photosensitive surface of the drum 1*a* to form a toner image 3*a*. The copy paper 4 is fed by a pair of feed rollers 13, one of which may be a register roller, and is transported to the transferring station as guided by guide plates 14.

The transfer corona charger 5 includes a corona wire 5*a* which is connected to the positive terminal of a high voltage supply 15. Thus, the charger 5 supplies positive charges to the rear surface of the copy paper 4 to transfer the toner image 3*a* onto the front surface of the copy paper 4. It should be noted that the charger 5 is provided with a first opening 5*b* opened toward the drum 1*a* and a second opening 5*c* opened toward the separating station, or belt 6. With such a structure, the charger 5 may apply positive charges to the belt as well as to the copy paper 4.

At the separating station, there is provided a conductive element belt 6 extended between a pair of pulleys 6*a*, 6*a*, one of which is disposed in the proximity of the drum 1*a* as compared with the other. The belt 6 is preferably comprised of a nickel sheet. Alternatively, use may be made of such material as stainless steel or carbon resin. One of the pulleys 6*a*, 6*a* is connected to a motor 16 through a power transmission system (not shown). A conductive roller 17 is provided in contact with the belt 6, and between the roller 17 and the ground are provided a capacitor 18, a constant voltage device 16 comprised of Zener diodes and a switch 17 all connected in parallel.

In operation, when the copy paper 4 is transported into the transfer station, the charger 5 is activated to apply positive charges onto the rear surface of the copy paper 4. At this time, the switch 20 is closed. So, when the leading edge of the copy paper 4 thus charged approaches the conductive belt 6 which is grounded through the roller 17 and the switch 20, charges of the negative polarity are distributed in that portion of the belt 6 which is opposed to the copy paper 5. Thus, as the drum 1*a* rotates, the leading portion of the copy paper 4 moves away from the drum 1*a* and becomes attracted onto the belt 6. As soon as the leading portion of the copy paper 4 is brought into contact with the belt 6. The switch 20 is made open. Therefore, positive charges applied from the charger 5 through the opening 5*c* now accumulate on the belt 6 until it reaches a predetermined value defined by the capacitor 18 and the constant voltage device 19. In this manner, an excellent separating performance without lowering the net transferring efficiency may be attained. The timing control of opening and closing of the switch 20 may be carried out by any conventional technique. For example, a microswitch 21 may be provided at an appropriate location, for example at the point P2, and a signal may be supplied to the switch 21 to cause it to open upon engagement with the leading edge of the copy paper 4.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A separating device for separating a transfer medium from a first carrier adapted to carry a toner image held electrostatically, said transfer medium having been previously brought into contact with said first carrier to transfer a toner image from said first carrier onto the front surface of said transfer medium by applying transfer charges of a polarity opposite to the polarity of the toner forming said toner image to the rear surface of the transfer medium, said separating device comprising means including a second carrier formed of an electrically conductive material and having a portion located close to said first carrier for attracting the leading edge of said transfer medium by electrostatic attraction between said transfer charges on the rear surface of the transfer medium and charges on said second carrier;

potential application means for applying a potential in the range between a predetermined first level and a predetermined second level to said second carrier, said first level being capable of electrostatically attracting the leading edge of said transfer medium toward said second carrier from said first carrier and said second level being capable of securely retaining the transferred toner image to the front surface of said transfer medium when said transfer medium is conveyed by said second carrier;

detecting means for detecting that said transfer medium has reached a reference position for supplying a detection signal; and timing control means for controlling the timing for changing the potential applied to said second carrier by said potential application means from said first level toward said second level in response to said detection signal such that said second carrier is applied with a potential of said first level until the leading edge of said transfer medium has been separated from said first carrier and electrostatically attracted and securely held to said second carrier.

2. A device according to claim 1 wherein said first carrier includes a photosensitive member driven to move along a first predetermined course and said second carrier includes an electrically conductive endless belt driven to advance along a second predetermined course a part of which is located close to said first predetermined course.

3. A device according to claim 2, wherein said first carrier further includes a rotatable drum on the periphery of which is mounted said photosensitive member, so that said first predetermined course is defined by the rotation of said drum.

4. A device according to claim 1, wherein said first level is ground potential and said second level is a predetermined potential of the polarity opposite to that of said toner image.

5. A device according to claim 4, wherein said potential application means includes a time constant circuit for insuring the gradual change of the potential to be applied to said second carrier from said first level to said second level with a predetermined time constant.

6. A device according to claim 1, wherein said timing control means includes a first timer started upon receipt of said detection signal and, after a first predetermined time period, initiates a gradual change of the potential to be applied to said second carrier from said first level potential to said second level potential.

7. A device according to claim 6, wherein said timing control means further includes a second timer started upon completion of the first predetermined time period by said first timer and, after a second predetermined time period which is long enough to complete the separating operation, causes said potential application means to apply said first level potential to said second carrier means thereby preparing for the next cycle of separating operation.

8. A device according to claim 1, wherein said detecting means includes a register roller for feeding said transfer medium onto said first carrier means with appropriate timing and said detection signal is supplied when said register roller is driven to rotate to start advancement of said transfer medium.

9. A device according to claim 1, wherein said detecting means includes a sensor disposed in the transporting path of said transfer medium and said sensor supplies said detection signal upon sensing of said transfer medium.

10. A device according to claim 9, wherein said sensor is a photoelectric sensor comprised of a light-emitting element and a light-receiving element.

11. A device according to claim 9, wherein said sensor is a mechanical sensor such as a feeler.

12. A device according to claim 1, wherein said detecting means includes an induced potential detecting circuit connected to said second carrier for detecting the arrival of said transfer medium at the reference position by detecting the fact that the induced potential produced in said second carrier by approaching of said transfer medium has reached a predetermined value.

13. A transfer type electrophotographic copying machine comprising:

a photosensitive member supported to move along a predetermined path;

image forming means for forming a toner image on the surface of said photosensitive member;

feeding means for feeding a transfer medium along a predetermined traveling path whereby the front surface of said transfer medium is brought into contact with the surface of said photosensitive member, transfer charging means for transferring said toner image onto the front surface of said transfer medium by applying charges of the polarity opposite to that of said toner image to the rear surface of said transfer medium; and separating means for separating said transfer medium from the surface of said photosensitive member, wherein said separating means includes:

means including an electrically conductive carrier member having a portion located close to said photosensitive member for separating and attracting the leading edge of said transfer medium to said portion by electrostatic induction;

potential application means for applying a potential in the range from a predetermined first level to a predetermined second level to said carrier member, said first level being capable of electrostatically attracting the leading edge of said transfer medium to said carrier member from said photosensitive member and said second level being capable of securely holding the transferred toner image in the front surface of said transfer medium when said transfer medium is placed on said carrier member;

detecting means for detecting the existence of said transfer medium at a reference position in its traveling path thereby supplying a detection signal; and timing control means for controlling the timing for changing the potential applied to said carrier member by said potential application means in response to said detection signal from said first level, which is normally applied to said carrier member, toward said second level, which is temporarily applied to said carrier member until completion of the separating operation, such that said timing control means keeps said carrier member substantially at said first level until the leading edge of said transfer medium has been separated and attracted to said carrier member from said photosensitive member due to electrostatic induction and is securely held to said carrier member.

14. A machine according to claim 13, wherein said photosensitive member is fixedly supported on the periphery of a drum which is driven to rotate at constant speed, and said carrier member includes an electrically conductive endless belt extended between a pair of pulleys at least one of which is driven to rotate to cause said belt to advance in association with the rotation of said drum.

15. A machine according to claim 14, wherein one of said pulleys is located closer to said photosensitive member than the other pulley.

16. A machine according to claim 14, wherein said feeding means includes a register roller which is driven to rotate in association with the rotation of said drum to feed said transfer medium and, at the same time, said detecting means supplies said detection signal.

17. A machine according to claim 13, wherein said detecting means includes a sensor disposed in the traveling path of said transfer medium and said sensor supplies said detection signal upon sensing of said transfer medium.

18. A machine according to claim 13, wherein said detecting means includes an induced potential detecting circuit connected to said carrier member for detecting the existence of said transfer medium at the reference position by detecting the fact that the induced potential produced in said carrier member due to approaching of said transfer medium reached a predetermined value.

* * * * *